United States Patent [19]

Eylon et al.

[11] Patent Number: 4,787,935

[45] Date of Patent: Nov. 29, 1988

[54] METHOD FOR MAKING CENTRIFUGALLY COOLED POWDERS

[75] Inventors: Daniel Eylon, Dayton, Ohio; Steven J. Savage, Farsta, Sweden

[73] Assignee: United States of America as represented by the Secretary of the Air Force, Washington, D.C.

[21] Appl. No.: 42,075

[22] Filed: Apr. 24, 1987

[51] Int. Cl.[4] ..... B22F 9/10

[52] U.S. Cl. ..... 75/0.5 C; 425/7

[58] Field of Search ..... 75/0.5 C; 264/12, 14; 266/148, 152; 425/7

[56] References Cited

U.S. PATENT DOCUMENTS

| | | | |
|---|---|---|---|
| 1,306,060 | 6/1919 | Hall | 264/14 |
| 2,032,215 | 2/1936 | Kemmer | 266/148 |
| 3,042,511 | 7/1962 | Reding Jr. | 266/148 |
| 3,446,877 | 5/1969 | Endler | 264/14 |
| 3,655,837 | 4/1972 | Reed et al. | 264/14 |

*Primary Examiner*—Wayland Stallard

*Attorney, Agent, or Firm*—Donald J. Singer; Bobby D. Scearce

[57] ABSTRACT

System and method for producing metal or alloy powder are described which comprises a housing defining a cylindrical chamber having an inlet and an outlet and a plurality of passageways in the form of fluid nozzles defined through the housing wall along axes oriented at preselected angle to the chamber wall, the passageways being operatively connected to a pressurized source of fluid so that fluid is injected into the chamber as fluid jets of preselected flow rate and is swirled in controllable helical fashion generally toward the chamber outlet, and a molten source of metal or alloy operatively connected through a molten metal nozzle and atomization die to the inlet of the chamber for directing molten particles into contact with the fluid jets for solidification and cooling along downward helical paths within the chamber. A plurality of concentric annular bins may be disposed near the outlet of the chamber for collecting powder formed within the chamber.

5 Claims, 1 Drawing Sheet

METHOD FOR MAKING CENTRIFUGALLY COOLED POWDERS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to systems and methods for producing metallic powders, and more particularly to system and method for producing spherical metallic powder of uniform size and tap density by centrifugal cooling.

In industrial applications of metal and alloy powders, spherical powders which flow well and have consistently high tap density are specially desirable in powder metallurgy processes for consolidation by way of vacuum hot pressing or hot isostatic pressing at high pressure to pressed parts with near net product shape. The density of the finished part, however, is further dependent upon particle density and porosity. Further, uniformity of size and shape of powder particles beneficially affects flow and compaction characteristics of the powder. Optimizing particle density and porosity along with controlling uniformity of particle size and shape is therefore critical in obtaining uniformly high tap densities in the powder product, and in obtaining optimum and predictable physical properties and dimensional reproducibility in a finished part.

Conventional methods for producing metallic powder include chemical methods wherein powder is produced by chemical decomposition of a metal compound, mechanical methods wherein the metallic form is mechanically comminuted to the desired particle size, and physical methods wherein a molten stream of a metal or alloy is atomized by impact with a fluid, usually gas, jet. Atomization processes are commonly used in producing metallic powders, and are the most convenient for producing alloy powders of the type required for modern high temperature applications. Such an atomization process is generally a two step process comprising providing a melt of the metal or alloy, followed by disintegrating a molten stream of the melt into droplets by impact with one or more high pressure fluid streams. Powders in the size range of from about 0.1 to about 1000 microns may be produced. In the production of rapidly solidified metallic powder utilizing gas atomization techniques, small particles solidify faster and often into a different microstructure than large particles; accordingly, microstructural uniformity in finished powder compacts requires close control of particle size in limited size ranges. Atomization processes may be applicable to the production of powders of most metals of interest including iron, tin, nickel, copper, aluminum, titanium, tungsten, molybdenum, tantalum, niobium and magnesium and alloys including stainless steels, bronze, brass and nickel/cobalt based superalloys. A comprehensive survey of conventional atomization techniques is presented in "Production of Rapidly Solidified Metals and Alloys", by S. J. Savage and F.H. Froes, J Metals 36:4, 20–33 (April 1984).

Existing gas atomization processes often produce powder which is not uniformly spherical, resulting from shortcomings in the processes allowing powder particles to collide with walls or other elements of the atomization equipment before the particles solidify and cool completely. The collisions result in irregularly shaped particles exhibiting poor powder flow and nonuniform tap density. Contamination of powder particles usually also results in part from erosion of impacted equipment surfaces, which contamination deleteriously affects fatigue resistance of a finished compacted part. Prior measures to avoid this problem have included building the atomization units large enough for particles to solidify before reaching a wall or other surface within the process equipment.

The invention solves or substantially reduces in critical importance the aforesaid problems with existing atomization processes for producing metallic powder. System and method are described for centrifugally cooling metallic powder as it is formed in an atomization process. In the method described, a stream of molten metal or alloy is atomized by impact with high pressure fluid to disintegrate the stream to droplets. The droplets are cooled by passage through a chamber into which coolant fluid is injected through a plurality of jets directed through the chamber walls at a predetermined angle, which results in a swirling motion of the fluid within the chamber and causes the metallic droplets to fall within the chamber in a helical path of controllable radius. Contact of the droplets with the chamber walls during cooling and solidification is thereby avoided. The powder product is uniformly spherical in shape, uniform in size and free of contamination. Chamber size may be kept substantially smaller than with previously known powder production processes. Suitable control of the process parameters of the invention may also allow separation by size of powder product and removal of high and low density occasional contaminants. The invention is applicable to the production of a large variety of metallic powders including the metals and alloys mentioned above.

It is therefore a principal object of the invention to provide improved rapid solidification method and system for producing spherical metallic powder.

It is another object of the invention to provide method and system for producing contamination free metallic powder.

It is a further object of the invention to provide method and system for producing metallic powder of uniform size and tap density.

These and other objects of the invention will become apparent as the description of representative embodiments proceeds.

SUMMARY OF THE INVENTION

In accordance with the foregoing principles and objects of the invention, system and method for producing metal or alloy powder are described which comprises a housing defining a cylindrical chamber having an inlet and an outlet and a plurality of passageways in the form of fluid nozzles defined through the housing wall along axes oriented at preselected angle to the chamber wall, the passageways being operatively connected to a pressurized source of fluid so that fluid is injected into the chamber as fluid jets of preselected flow rate and is swirled in controllable helical fashion generally toward the chamber outlet, and a molten source of metal or alloy operatively connected through a molten metal nozzle and atomization die to the inlet of the chamber for directing molten particles into contact with the fluid jets for solidification and cooling along downward helical paths within the chamber. A plurality of concentric annular bins may be disposed near the outlet of the chamber for collecting powder formed within the chamber.

DESCRIPTION OF THE DRAWINGS

The invention will be understood from the following description of representative embodiments thereof read in conjunction with the accompanying drawings wherein.

DETAILED DESCRIPTION

Figure 1:
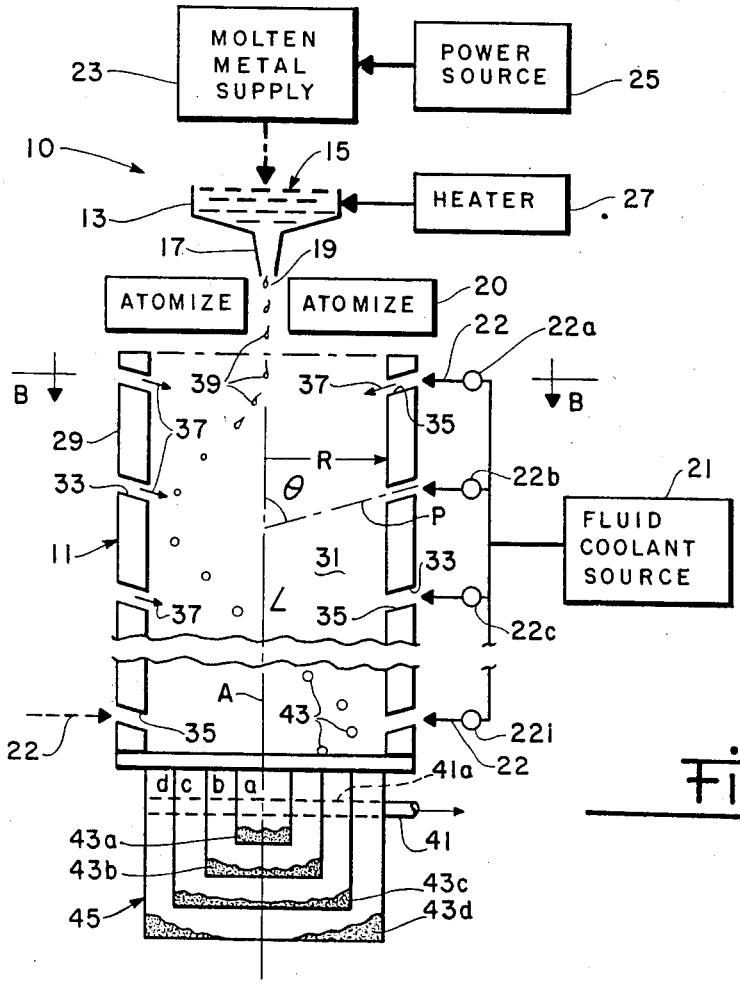
FIG. 1 is a schematic of a powder production system of the invention and which is useful in practicing the method thereof.

Referring now to the drawings, FIG. 1 is a schematic of a representative metallic powder production system 10 useful in practicing the invention. It is understood that the invention described herein may be applied to production of metallic powder from a wide range of metals and alloys, and threfore, as used herein, the words "metal" or "metallic" are construed to describe and to include reference to both metals and alloys.

Figure 2:
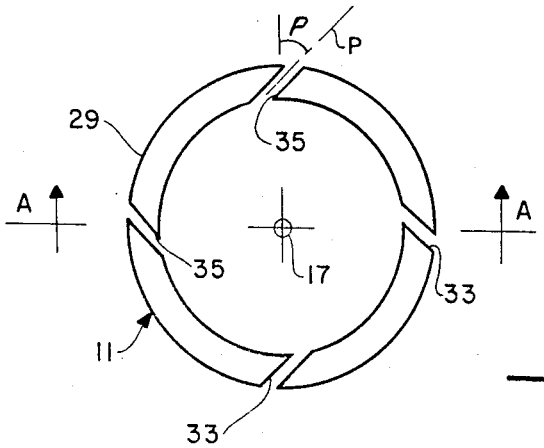
FIG. 2 is a view along line B—B of FIG. 1.

System 10 includes a housing defining atomizer chamber 11 of novel configuration, container 13 for supporting a pool of molten metal or alloy 15 and having nozzle means 17 for defining a molten metal stream 19 for atomization, atomization die 20 or other means for atomizing stream 19 and injecting molten droplets into chamber 11, and high pressure source 21 of fluid coolant for cooling the molten droplets into powder in the practice of the invention. FIG. 1 is an axial sectional view of chamber 11 and FIG. 2 is a sectional view of chamber 11 along line B—B of FIG. 1.

Container 13 may take any desired form as would occur to one with skill in the applicable art for providing a molten metal stream 19 of preselected size and flow rate. Accordingly, container 13 may comprise a crucible having a pouring spout defining nozzle 17 or other means for defining stream 19 and selectively directing it into atomization die 20 and chamber 11. Molten metal 15 may be poured from a separate furnace comprising molten metal supply 23 fused using controllable power source 25. Molten metal supply 23 may comprise any conventional melting process such as induction, electron beam, tungsten arc, plasma or laser heating in air, inert gas or vacuum. However, to avoid contamination problems resulting from contact of the melt with a crucible or nozzle, supply 23 may comprise skull melting of the selected metal combined with edge pour as a preferred scheme. Further, container 13 itself may comprise a molten source fused by heater 27 without a separate molten supply. In particular, and to ensure purity of stream 19, container 13 and heater 27 may comprise an electromagnetically powered levitation melting system described in copending application serial number 07/042,074 filed Apr. 22, 1987, entitled "A Method for Making Rapidly Solidified Powder".

Chamber 11 is cylindrical along axis A and includes cylindrical wall 29 defining cylindrical operating volume 31 of preselected radius R and length L wherein powder solidification and cooling occurs in the practice of the invention. Chamber 11 is preferably constructed of stainless steel, aluminum, titanium, zirconium, copper or other ceramic, cermet, or alloy or other material as would occur to the skilled artisan which is nonreactive with molten metal 15 at anticipated operating temperatures. However, as will become apparent from the description below, in the solidification and cooling process, contact of the powder with wall 29 is substantially avoided. Wall 29 of chamber 11 includes a plurality of passageways 33 of preselected size circumferentially spaced around wall 29 and along the length of chamber 11. Passageways 33 are defined through wall 29 along respective axes P each inclined relative to wall 29 as defined below. Any number and placement of passageways 33 may be used, the sets of four spaced at 90° as shown in the figures being only illustrative.

Source 21 may comprise nitrogen, argon, helium, methane, carbon dioxide, hydrogen or other gaseous or liquid material conventionally used in fluid atomization processes, and substantially any fluid atomization process may be incorporated into the system and method of the invention as would occur to the skilled artisan guided by these teachings, the same not being limiting of the invention. Connection means 22 operatively interconnect source 21 with passageways 33. Under high pressure fluid flow from source 21, passageways 33 define nozzles 35 for injection of fluid jets 37 into chamber 11 at preselected nozzle velocity and flow rate. Axes P are inclined such that each fluid jet 37 is injected along a vector having known preselected mutually orthogonal components respectively along a radius of chamber 11, parallel to axis A and tangent to wall 29. The projection of an axis P in the plane of FIG. 2 therefore is inclined at a preselected acute angle $\rho$ to a radius of chamber 11, and the projection of axes P in a plane through axis A and a nozzle 35 of chamber 11 (FIG. 1) forms angle $\theta$ relative to axis A.

In the practice of the invention, stream 19 is directed into atomization die 20 and is atomized into molten droplets 39 of size depending on stream 19 size and flow rate and the atomization process governing the operation of atomization die 20. Droplets 39 are then passed into chamber 11 for solidification and cooling. The angular injection of fluid through jets 37 results in fluid flow within chamber 11 which is helical about axis A toward outlet 41 of chamber 11. Droplets 39 are therefore cooled in helical paths in traversing chamber 11 downwardly along axis A as suggested in FIG. 1. Optimum combination of chamber 11 dimensions, nozzle placement and velocity, and fluid injection angle and flow rate results in stream 19 being atomized and droplets 39 being cooled in a helical path without contacting wall 29. As droplets 39 solidify and fall along the length of chamber 11, some increase in velocity of the falling particles will result from gravitation acceleration; accordingly, coolant flow rates through respective connection means 22 may be controlled by regulators **22*a–i* to selectively vary jet 37 velocities along the length of chamber 11 to maintain substantially constant radius of swirl as powder falls along axis A. For example, jets 37 directed at an angle $\rho$ of about 10° to 45° and $\theta$ of about 60° at flow rate of about 100 cpm in a chamber 11 of radius 40 inches results in formation and solidification of acceptable powder product of from about 0.1 to about 1000 microns in diameter, and sufficient length L for chamber 11 up to about 12 feet allows droplets 39 to cool and solidify into spherical powder particulates 43 before reaching the bottom of chamber 11. Suitable control of the operating parameters allows control of the cooling rate for droplets 33** within a desirable range of about $10^2$ to about $10^7$ centigrade degrees per second. It is understood that these parameters are only representative of an operable system, and other system configuration and operating parameters may be developed by one with skill in the field of the invention guided by these teachings for the production of selected metallic powders in selected sizes and size ranges. Powders of substantially any metal or alloy thereof may be made according to the system and method described herein. A nonlimiting, representative such group includes the metals iron, cobalt, nickel, aluminum, titanium, niobium, tin, copper, tungsten, molybdenum, tantalum and magnesium, and the alloys bronze, brass, lithium alloys, stainless steels and nickel/cobalt based superalloys.

It is noted that, within the contemplation of the invention, chamber 11 itself may serve as an atomization die and preclude the need for separate atomization means 20. In this arrangement coolant flow through the uppermost nozzles may be specially controlled, for example in controlled spurts of jets 37 therefrom, by suitable control of regulators 22*a,b* so that stream 19 injected directly into chamber 11 is atomized in the upper part of chamber 11 by the controlled jets. Chamber 11 may thusly both form and cool particles 43.

The powder formed by the process just described will traverse a helical path having a radius relative to axis A which, for the same operating parameters, will be dependent upon the mass of droplets 39 formed at nozzle 17. Notwithstanding existing limitations on conventional gas atomization processes, particle size of product made by the method of the invention may be controlled within a size range of approximately 100 microns. The swirling motion of particles 43 in the respective downward helical paths about axis A results in separation of coarse/heavy particles having small surface-to-volume ratio and/or large mass into short radii helical paths; lighter or finer powder particles traverse helical paths of relatively larger radii and closer to wall 29. Accordingly, any suitable plurality of concentric annular bins, such as represented in FIG. 1 as bins 45*a–d*, may be disposed near outlet 41 of chamber 11, and may be configured as individual sieves or the like for venting coolant therethrough; outlet 41 may comprise passageway 41a interconnecting each bin 45*a–d* in manner familiar to the skilled artisan to facilitate exhaust of coolant fluid from chamber 11 through outlet 41. Powder particles 43 may therefore fall into selected bins 45 dependent on the respective radii of their helical paths; rough classification of powder 43 into size fractions 43*a–d* is thereby provided which facilitates further classification by sieving. Also, the swirling motion of particles formed within chamber 11 may be controlled and the radius of the helical path of metallic powder 43 product of desired mass and size range may be defined to separate occasional contaminants from the powder product; low density contaminants traverse large radii helical paths and are collected into large diameter bins 45, while high density contaminants on helical paths near axis A are collected into small diameter bins 45; powder product is collected in the intermediate sized bins.

The invention therefore provides system and method for production of uniformly spherical, contamination free, rapidly solidified metal and alloy powder. It is understood that certain modifications to the equipment defining the system of the invention or to the operative steps of the method may be made, as might occur to one with skill in the field of this invention, within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A method for producing powder of metal or alloy material comprising:

(a) providing a molten stream of said material;

(b) providing a pressurized source of fluid;

(c) providing a housing having a substantially cylindrical wall defining along a central first axis a generally cylindrical chamber having preselected radius and an inlet at a first end thereof and an outlet at a second end thereof, said cylindrical wall including means defining a plurality of passageways through said wall along respective second axes each oriented with respect to said wall along a vector having preselected mutually orthogonal components respectively along a radius of said chamber, along said first axis and tangent to said wall, said passageways spaced both circumferentially and lengthwise of said cylindrical wall;

(d) atomizing said molten stream into molten droplets of said material;

(e) injecting said fluid through said passageways into said chamber under pressure sufficient to generate a plurality of vaporous fluid of preselected flow rate whereby said vaporous fluid is helically swirled within said chamber and directed generally toward said second end of said chamber;

(f) directing said molten droplets through said chamber in contact with said vaporous fluid jets whereby said droplets are swirled within said chamber toward said second end thereof and cooled to form powder of said material within said chamber; and (g) collecting said powder.

2. The method of claim 1 wherein said material comprises a metal selected from the group consisting of iron, cobalt, nickel, aluminum, titanium, niobium, tin, copper, tungsten, molybdenum, tantalum and magnesium.

3. The method of claim 1 wherein said material is an alloy of a metal selected from the group consisting of iron, cobalt, nickel, aluminum, titanium, niobium, tin, copper, tungsten, molybdenum, tantalum and magnesium.

4. The method of claim 1 wherein said material is an alloy selected from the group consisting of titanium-aluminum, nickel-aluminum, magnesium-lithium, copper-tin, aluminum-copper, bronze, brass and stainless steel.

5. The method of claim 1 wherein said fluid is a material selected from the group consisting of argon, helium, nitrogen, methane, carbon dioxide and hydrogen.

* * * * *